United States Patent [19]

Isawa

[11] Patent Number: 4,724,506

[45] Date of Patent: Feb. 9, 1988

[54] POWER-SAVING SYSTEM FOR BOWLING MACHINE

[75] Inventor: Heiichi Isawa, Sendai, Japan

[73] Assignee: Katsuyama Kigyo Kabushiki Kaisha, Japan

[21] Appl. No.: 918,308

[22] Filed: Oct. 14, 1986

[30] Foreign Application Priority Data

Jul. 8, 1986 [JP] Japan ..... 61-158795

[51] Int. Cl.[4] ..... H01H 47/24; A63D 5/00

[52] U.S. Cl. ..... 361/170; 361/173; 273/43 R; 273/54 R

[58] Field of Search ..... 361/170, 173; 273/43 R, 273/54 R, 43 A

[56] References Cited

U.S. PATENT DOCUMENTS 3,195,892 7/1965 Hildebrant et al. ..... 273/43 A 4,151,993 5/1979 Payne et al. ..... 273/43 A

*Primary Examiner*—L. T. Hix

*Assistant Examiner*—David M. Gray

*Attorney, Agent, or Firm*—Lowe, Price, Leblanc, Becker & Shur

[57] ABSTRACT

A power-saving system for use with a bowling machine which initiates motor operation when a bowling ball passes a position in front of the pit cushion and deactivates the motor upon the bowling ball return sequence. The system comprises a switch for controlling power to the motor which is activated upon detection of the bowling ball passage past a position in front of the pit cushion. Detection of the return of the bowling ball onto the track deactivates the switch. A circuit includes a group of switches for detecting various functions of the machine cycle to hold the switch in an activated state.

4 Claims, 6 Drawing Figures

POWER-SAVING SYSTEM FOR BOWLING MACHINE

BACKGROUND OF THE INVENTION

1. Field of the Invention

The present invention relates to a power-saving system for bowling machines.

2. Prior Art

With the prior art bowling machine, a game is started by turning on a machine switch within a front. At the same time, a motor for the bowling machine is actuated, and is continuously operated until the game is over.

A machine cycle comprising a series of operations of a rake, a plunger, a turret and the like is initiated by actuating a cycle solenoid with a force with which a bowl strikes upon a pit cushion, followed by clutching.

According to the conventional bowling machine as stated in the foregoing, a game is started by turning on a machine switch within a front. At this time, a machine motor is actuated, and is continuously operated until the game is over. Thus, the motor in the prior art is continues to run, while the bowler selects his or her bowl, writes his or her name on the given sheet or makes preparations for bowling, or during a period between the first play and the second play or for changing bowlers. In other words, the motor needs to be at work even during a period for which its operation is not originally required, resulting in a waste of energy.

The machine cycle is initiated by actuating the cycle solenoid with a force which a bowling ball strikes upon the pit cushion and thereby engaging the clutch. In the case of a lightweight bowling ball or a bowling ball only a small impact, however, there is a possibility that the cycle solenoid may not be actuated, failing to initiate the machine cycle. In such a case as mentioned above, the prior art is designed such that a reset button is manually actuated to initiate the machine cylce. However, this results in a delay in the progress of a game, and gives rise to unnecessary operation of the motor.

SUMMARY OF THE INVENTION

An object of the present invention is therefore to provide a power-saving system for bowling machines, which can save electric power by interrupting the operation of a motor for a period during which its operation is not needed, and which corresponds substantially to a machine cycle.

Preferably, an additional object of the present invention is to provide a power-saving system for bowling machines, which prevents a delay in the progress of a game and thereby saves electric power by automatically effecting resetting for the initiation of a machine cycle, when that machine cycle is not initiated within a certain period of time.

According to the present invention, the foregoing and other objects are achieved by the provision of a power-saving system used with a bowling machine wherein a machine cycle is initiated by the collision of a bowl upon a pit cushion for carrying out a series of various functions, said power-saving system comprising in combination:

switching means for turning on or off the supply of power to a motor, means for detecting the passage of the bowling ball past a predetermined position in front of the pit cushion to turn activate said switching means, means for detecting the return of the bowling ball onto a track to deactivate said switching means, and circuit means including a group of switches for detecting said series of various functions of the machine cycle to hold said switching means in an activated state.

Preferably, the power-saving system for bowling machines according to the present invention further includes means for manually initiating the machine cycle, when a given period of time passes after the collision of the bowl upon the pit cushion.

Preferably, the detection of the passage of the bowl is performed at a position which, for the purpose of power saving, is located as far from the pit cushion as possible, and should be not adversely affected by pins on an array head. A position preferable to this end is one in front of a kickback. The detection means may preferably be a photoelectric switch, for instance.

The group of switches comprises a switch which is mounted on a rake and is activated to an on state on in response to the rake being operable, a plunger lever switch mounted on a plunger lever activated into an on state in response to the plunger lever being operable, and a switch mounted on a turret and activated to an off state in response to a pin deck being full of pins.

In the present invention, the supply of electric power to the motor is controlled by the electromagnetic contact means, which is activated by detecting the passage of the bowl past the predetermined position located in front of the pit cushion. The on-off control of the electromagnetic contact means is performed by self-holding means which is activated and held on upon the electromagnetic contact means being put on, and "or" circuit means which is arranged in parallel therewith and is held on, while the various fuctions of the machine cycle are at work. The self-holding of the self-holding means is deactivated and released by detecting the return of the bowling ball onto the bowl track. In consequence, when the bowling ball is returned onto the bowl track and the functions of the machine cycle are all completed, the electromagnetic contact means is turned off, whereby the supply of power to the motor and hence the operation of the motor is interrupted.

BRIEF DESCRIPTION OF THE DRAWINGS

In the following, the present invention will now be explained in detail with reference to FIGS. 1 to 4, which are given for the purpose of illustration alone, and in which.

PREFERRED EMBODIMENTS OF THE INVENTION

Figure 1:
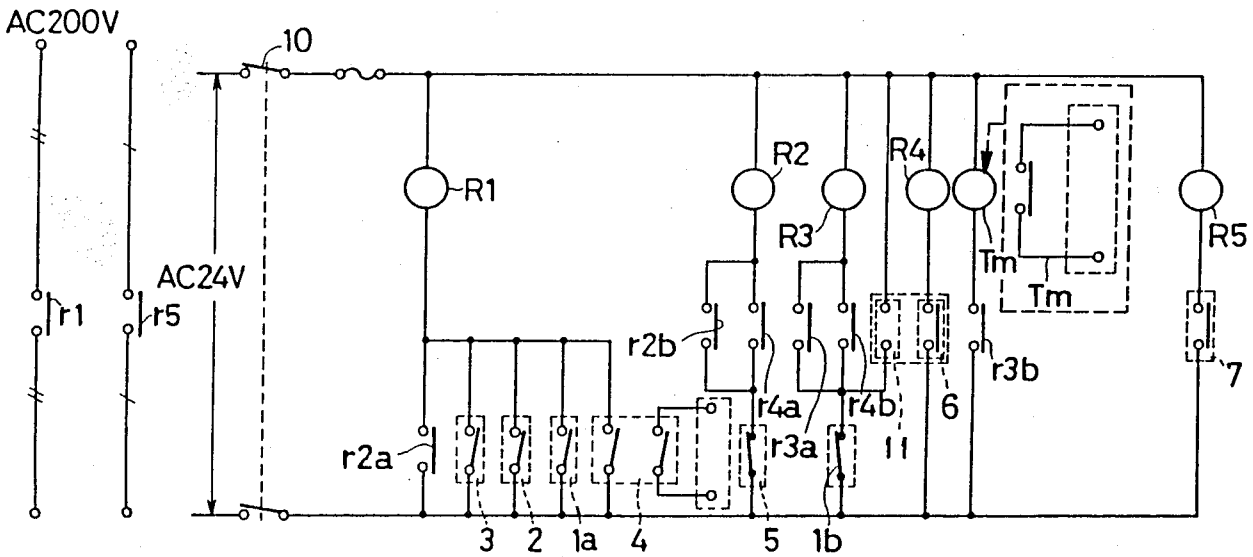
FIG. 1 is a circuit diagram showing the overall arrangement of one embodiment of the power-saving system for bowling machines according to the present invention, FIGS. *2a*, *2b* and *2c* are front, plan and rear views showing the control box for housing main circuit portions in that embodiment.

Reference will first be made to FIG. 1 which is a circuit diagram showing the overall arrangement of one preferred embodiment of the power-saving system for bowling machines according to the present invention.

In parallel relation to relays R2, R3, R4 and R5 as well as a timer Tm, an electromagnetic contactor R1 is connected to an AC power source of, e.g., 24 V through a snap switch. Connected in series to a coil of electromagnetic contactor R1 are a contact of relay R2, a contact 1*a* of a microswitch on a rake, a contact 2 of a microswitch below a plunger lever, a contact 3 of a turret microswitch and a manual snap switch 4 which are arranged in parallel with one another. Connected in series to a coil of relay R2 are a contact r2*b* of relay R2 and a contact r4*a* of relay R4 which are connected in parallel to each other and a microswitch 5 on a bowling ball return track. Connected in series to a coil of relay R3 are a contact r3*a* of relay R3 and a contact r4*b* of relay R4 and a b contact 1*b* of the-microswitch-on-the-rake. Connected in series to a coil of relay R4 is a photoelectric switch 6. Connected in series to timer Tm is a contact of relay R3. Connected in series to a coil of relay R5 is a governor switch 7. A motor is connected to an AC power source of, e.g., 200 V via a contact r1 of electromagnetic contactor R1, and the governor is connected thereto via a contact r5 of relay R5. In FIG. 1, it is noted that reference numeral 10 stands for a power source switch for driving photoelectric switch 5.

Figure 2:
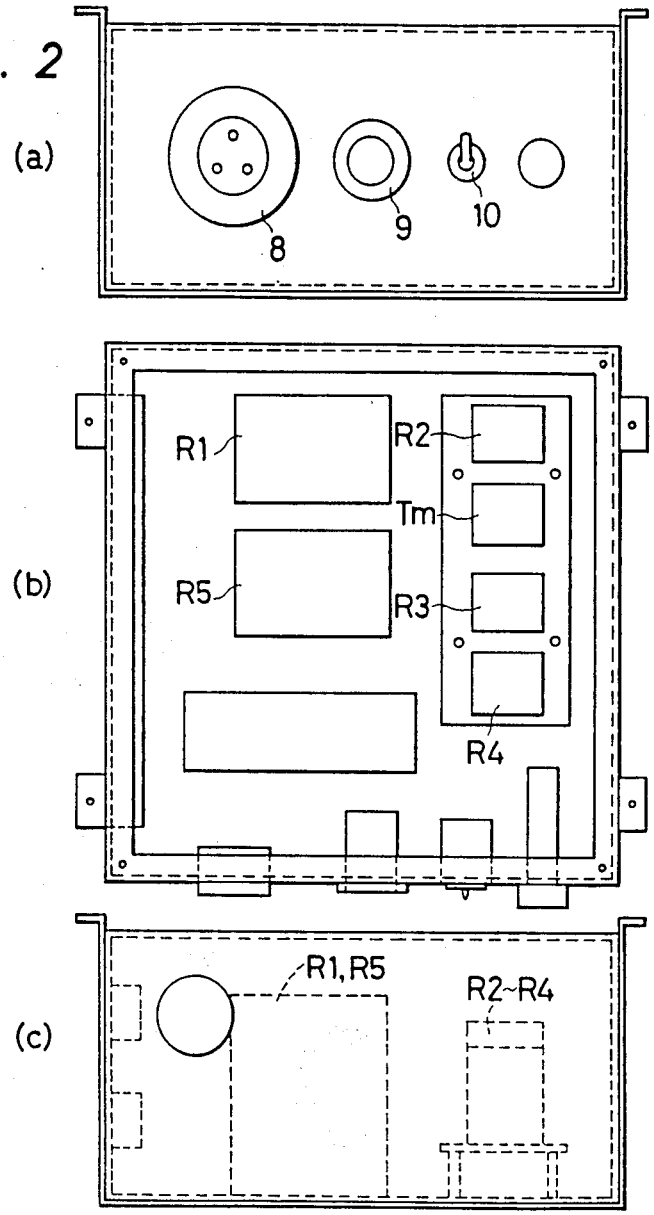

FIG. 2 illustrates a control box mounted on a wooden plate on a bowl wheel, within which electromagnetic contactor R1, relays R2~R5 and timer Tm are housed. A power source connector 8 is provided for the motor. A cable connector 9 is provided to obtain a power source from the machine body. A snap switch 10 is provided to turn on and off the supply of operating power source.

Figure 4:
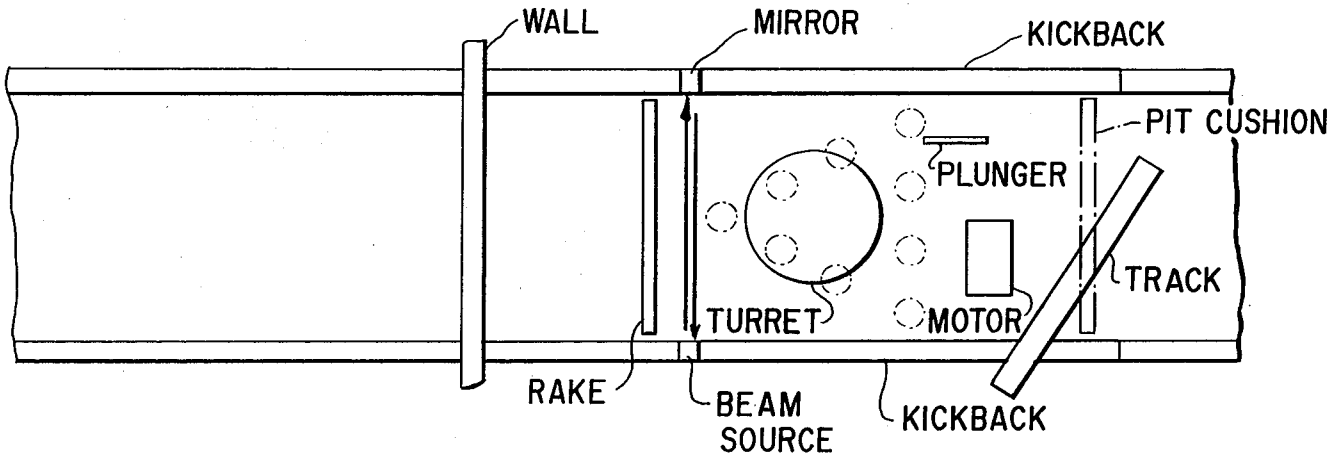
FIG. 4 shows the placement of the bowling detection means in front of the pit cushion.

The photoelectric switch 6 is positioned in front of a kickback as shown in FIG. 4 to sense the passage of a bowling ball and thereby put on relay R4 in the aforesaid electric circuit. Where the machine is in a standby mode prior to (actuation), the microswitches 1*a* and 1*b* mounted on the rake are held off and on, respectively. As the bowling ball strikes the pit cushion, the rake descends and is not returned to the original position during the cycle, so that the microswitches 1*a* and 1*b* are held on and off, respectively. Consequently, the electromagnetic contactor R1 is held on during the machine cycle. On the other hand, the relay R3 connected to contact 1*b* and the elelcromagnetic switch power source 10 are held off after the actuation of the machine.

The plunger lever is pulled up under the action of the cycle solenoid, and the microswitch 2 mounted therebelow is held on during the machine cycle, and is turned off during the beginning of the machine cycle (before actuation and after the completion of the machine cycle), whereby the electromagnetic contactor R1 is held on during the machine cycle. This switch serves to actuate the motor in the case where the machine is cycled in the absence of a bowling ball (a reset button is pressed down).

The-microswitch 3-on-the-turret-frame is turned on when a pin deck is full of pins, and is held off in the absence of any pin. Accordingly, the electromagnetic contactor R1 is held on until the pin deck becomes full of pins.

Referring to the-microswitch 5-on-ball-track, its b contact is turned off by the passage of a bowling ball, whereby the self-holding of relay R2 connected to the b contact is released, so that the electromagnetic contactor R1 is in an off state.

It is appreciated that while microswitches are used as the switches in the instant embodiment, the present invention is not exclusively limited thereto. For instance, limit switches may be used.

Figure 3:
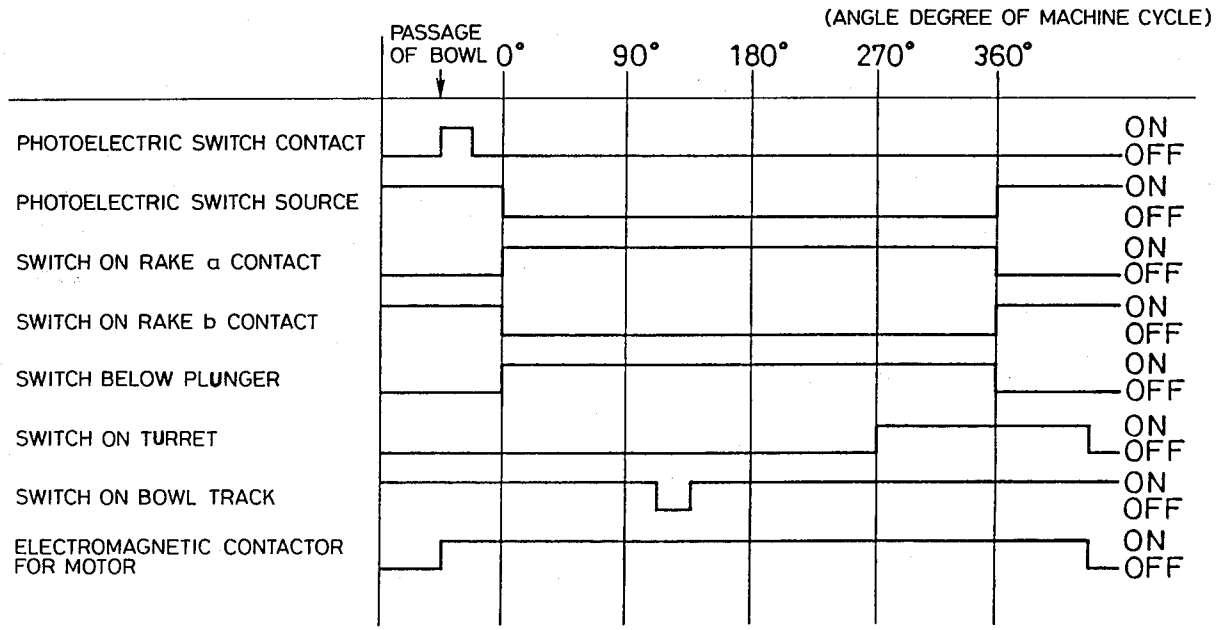
FIG. 3 is a graphical view illustrating the operation of the respective switches in the machine cycle.

FIG. 3 illustrates the operation of the switches during the machine cycle. Let us suppose that one cycle of the machine ranges from 0° to 360°. Then, the machine senses pins in a 90° cycle, removes lying pins on a lane in a 180° cycle, rearrange pins in a 270° cycle, and is restored to the starting position in a 360° cycle. The-switch 5-on-the-bowling ball return-track operates depending upon bowling ball, and so does the-switch 3-on-the-turret.

Now assume that the bowling ball passes in front of photoelectric switch 5 positioned in front of the kickback. Then, the photoelectric switch is closed to excite the coil of relay R4, so that its contacts r4*a* and r4*b* are closed to activate relays R2 and R3. Upon the relay R2 being activated, it contact r2*a* is closed to activate electromagnetic contactor R1, so that the motor is connected to the power source. At the same time, the contact r2*b* is closed so that the relay R2 is held on. Thus, even after the photoelectric switch 5 is turned off, the self-holding of relay R4 is achieved.

Upon the bowling ball striking upon the pin cushion, the machine cycle is initiated after the lapse of about three (3) seconds. After striking upon the pit cushion, the bowling ball is returned to the bowler through the bowling ball return track. At that time, the self-holding circuit of relay R2 is released by switch 5 on the bowling ball return track to deactivate electromagnetic contactor R1 and thereby stop the motor. However, if returning of the bowling ball takes place at an early stage, viz., if the machine is being cycled, then switch 1*a*-on-the-rake and plunger lever switch 2 causes the motor to continue operating until the completion of the cycle. Further, the motor is continued to work by the tarret frame until the pin deck becomes full of pins.

Thus, the motor is actuated by the passage of the photoelectric switch, and is stopped, where the machine is in standby mode prior to activation, pins are present in the deck and the bowling ball is returned. The relay R3 feeds a power source to timer Tm via its contact r3*b*. When the machine is not cycled even after the lapse of 4~5 seconds from the time at which the relay R3 activated, the timer Tm serves to actuate the cycle solenoid to force a cycling of the machine. In the usual cycle, the timer is not activated, since the self-holding cirucit of relay R3 is released by the switch contact 1*b* on the rake, before the actuation of the timer. In the manner as mentioned above, the machine cycle is always initiated within about five (5) seconds.

To prevent any malfunction, the photoelectric switch 6 remains deactivated during the machine cycle, since its power source is connected to the switch contact 1*b* on the rake.

All the driving forces of the motor are transmitted by means of various belts. However, as the motor stops, all the movements of the belts stop in connection with the gear box, the bowl pin elevator, the pit conveyor and the turret.

No substantial problem arises as to the influence of repeated actuation and interruption upon the machine. This is because the moment the bowling ball strikes the pit cushion, the actuation of the motor has already taken place through the signal from the photoelectric switch. In other words, the machine according to the present invention is actuated under the circumstances similar to those applied to the conventional machine. However, the use of a single-phase motor of, e.g., 200 V and 0.75 KW often results in the governor contact being damaged. For that reason, it is substituted by contact r5 of electromagnetic contactor R5 to reduce the damage thereof. The amount of heat generated by the motor is also increased. Thus, fans can be attached to the pulleys to prevent any temperature increases.

In what follows, the effect of the power-saving system according to the present invention will be explained with reference to the results of experiments carried out with some testing machines into which the power-saving system according to the present invention is incorporated.

Power reductions achieved with the testing machines were 23~31%, as set forth in Table 1. It is understood that variations in the power reduction shown in Table 1 were due to unsatisfactory machine regulation (in connection with zero order and turret), reduction or increases in the number of pins, loads applied upon the machine, etc. As clearly noted from Table 1, the power reduction reached a high of 34.9% (Testing Machine No. 2; Experiment No. II). The average power reductuion was 27.9% for Testing Machine No. 1, 31.4% for Testing Machine No. 2 and 23.3% for Testing Machine No. 3. It is noted that a power reduction of 12.8% achieved with Testing Machine No. 3 (Experiment No. VI) was due to unsatisfactory machine regulation. Referring to Testing Machine No. 1, the rate of operation was 47% on average from the machine working time and the actual motor-working time; this meaning that the time of operation of the motor was diminished to less than a half. The service life of various bearings were thereby extended to that degree. A reduced power reduction relative to the actual rate of operation of the motor was due to the fact that an increased amount of power was required for the actuation of the motor.

If the initiation of the machine cycle is automated, then the progress of a game is accelerated, thereby saving power to that extent. Further, since the motor is actuated by the signal from the photoelectric switch, it is actuated under a smaller load in a stage earier than that for the initiation of the machine cycle. For that reason, any burden is not possibly applied on the motor. In the event that fans are attached in place, the motor is maintained at a temperature similar to that resulting from its continuous operation, thereby avoiding any burning of actuation coils, etc.

TABLE

| | Experiment I | Experiment II | Experiment III | Experiment IV | Experiment V | Experiment VI | Experiment VII | Total | |
|---|---|---|---|---|---|---|---|---|---|
| Normal Machine | | | | | | | | | |
| Power Used(KW) | 53.12 | 57.15 | 54.81 | 58.67 | 53.91 | 65.88 | 56.48 | 400.02 | 0.86 KW/H |
| Working Time(H) | 62.59 | 66.78 | 63.75 | 67.99 | 62.21 | 74.75 | 66.4 | 464.47 | |
| Testing Machine No. 1 | | | | | | | | | |
| Power Used(KW) | 36.19 | 40.97 | 34.12 | 40.96 | 39.7 | 50.65 | 38.72 | 282.03 | |
| Working Time(H) | 59.70 | 62.18 | 56.77 | 69.13 | 64.9 | 78.85 | 65.44 | 456.97 | |
| Actual Working Time(H) | 29.48 | 32.36 | 24.25 | 30.65 | 29.92 | 39.63 | 28.45 | 212.74 | |
| Rate of Operation(%) | 49 | 52 | 43 | 44 | 46 | 50 | 43 | 47 | |
| Power Reduction | 27.9 | 23.3 | 30.2 | 31.4 | 29.1 | 25.6 | 31.4 | 27.9 | |
| Testing Machine No. 2 | | | | | | | | | |
| Power Used(KW) | 34.08 | 38.56 | 36.94 | 42.49 | 39.66 | 45.13 | 41.03 | 277.89 | |
| Working Time(H) | 58.14 | 68.15 | 63.55 | 73.05 | 65.5 | 77.24 | 68.06 | 472.69 | |
| Power Reduction | 31.4 | 34.9 | 32.6 | 31.4 | 29 | 32.6 | 30.2 | 31.4 | |
| Testing Machine No. 3 | | | | | | | | | |
| Power Used(KW) | 38.44 | 43.96 | 36.04 | 43.28 | 42.24 | 57.47 | 42.86 | 304.29 | |
| Working Time(H) | 58.37 | 67.38 | 58.75 | 71.09 | 63.01 | 75.85 | 66.4 | 460.85 | |
| Power Reduction | 23.3 | 24.4 | 29 | 29 | 22.1 | 12.8 | 24.4 | 23.3 | |

*Testing Machine Nos. 1, 2 and 3 included the power-saving system according to the present invention.

Obviously, many modifications and variations of the present invention are possible in the light of the aforesaid teachings. It is therefore to be understood that within the scope of the appended claims, the invention may be practiced otherwise than as specifically described.

We claim:

1. A power-saving system used with a bowling machine wherein a machine cycle is initiated by the collision of a bowling ball upon a pit cushion for carrying out a series of various functions, said power-saving system comprising:

switching means for turning on or off the supply of power to a motor, means for detecting the passage of the bowling ball past a predetermined position in front of the pit cushion to activate said switching means, means for detecting the return of the bowling ball onto a track to deactivate said switching means, and circuit means including a group of switches for detecting said series of various functions of the machine cycle to hold said switching means in an on activated state.

2. The system as recited in claim 1, which further includes means for forcedly initiating the machine cycle, when a certain time passes after the collision of the bowling ball upon the pit cushion.

3. The system as recited in claim 1, wherein said passage detecting means is positioned in front of a kickback, the kickback being at a position in front of the pit cushion, said passage detecting means including a photoelectric switch located to detect passage of the bowling ball.

4. The system as recited in claim 1, where said group of switches comprises a switch which is mounted on a rake and is activated to an on state in response to the rake being operable, a plunger activated into an on state in response to the plunger lever being operable, and a switch mounted on a turret and activated to an off state in response to a pin deck being full of pins.

* * * * *